United States Patent [19]

Taylor

[11] 4,001,917

[45] Jan. 11, 1977

[54] CARDING APPARATUS

[76] Inventor: Roy Taylor, 5, Tunstall Road, Oldham, Lancashire, England

[22] Filed: May 8, 1975

[21] Appl. No.: 575,810

Related U.S. Application Data

[63] Continuation-in-part of Ser. No. 516,581, Oct. 21, 1974, abandoned.

[30] Foreign Application Priority Data

May 10, 1974 United Kingdom ..... 20672/74
Oct. 25, 1974 United Kingdom ..... 46376/74

[52] U.S. Cl. ..... 19/104
[51] Int. Cl.[2] ..... D01G 15/24; D01G 15/28
[58] Field of Search ..... 19/98, 104, 110, 113, 19/96

[56] References Cited

UNITED STATES PATENTS

| | | | |
|---|---|---|---|
| 620,089 | 2/1899 | Threlfall | 19/105 |
| 2,167,808 | 8/1939 | Litty | 19/104 X |
| 2,305,639 | 12/1942 | Rockwell, Jr. | 19/96 |
| 3,402,432 | 9/1968 | Kalwaites | 19/104 |

FOREIGN PATENTS OR APPLICATIONS

| | | | |
|---|---|---|---|
| 400,971 | 11/1933 | United Kingdom | 19/104 |
| 702,713 | 1/1954 | United Kingdom | 19/105 |

*Primary Examiner*—Dorsey Newton
*Attorney, Agent, or Firm*—Norris & Bateman

[57] ABSTRACT

Fibre processing machinery including carding plates wherein means are provided for carefully adjusting the relative settings of adjacent components of the carding plates.

10 Claims, 9 Drawing Figures

Figure 1:
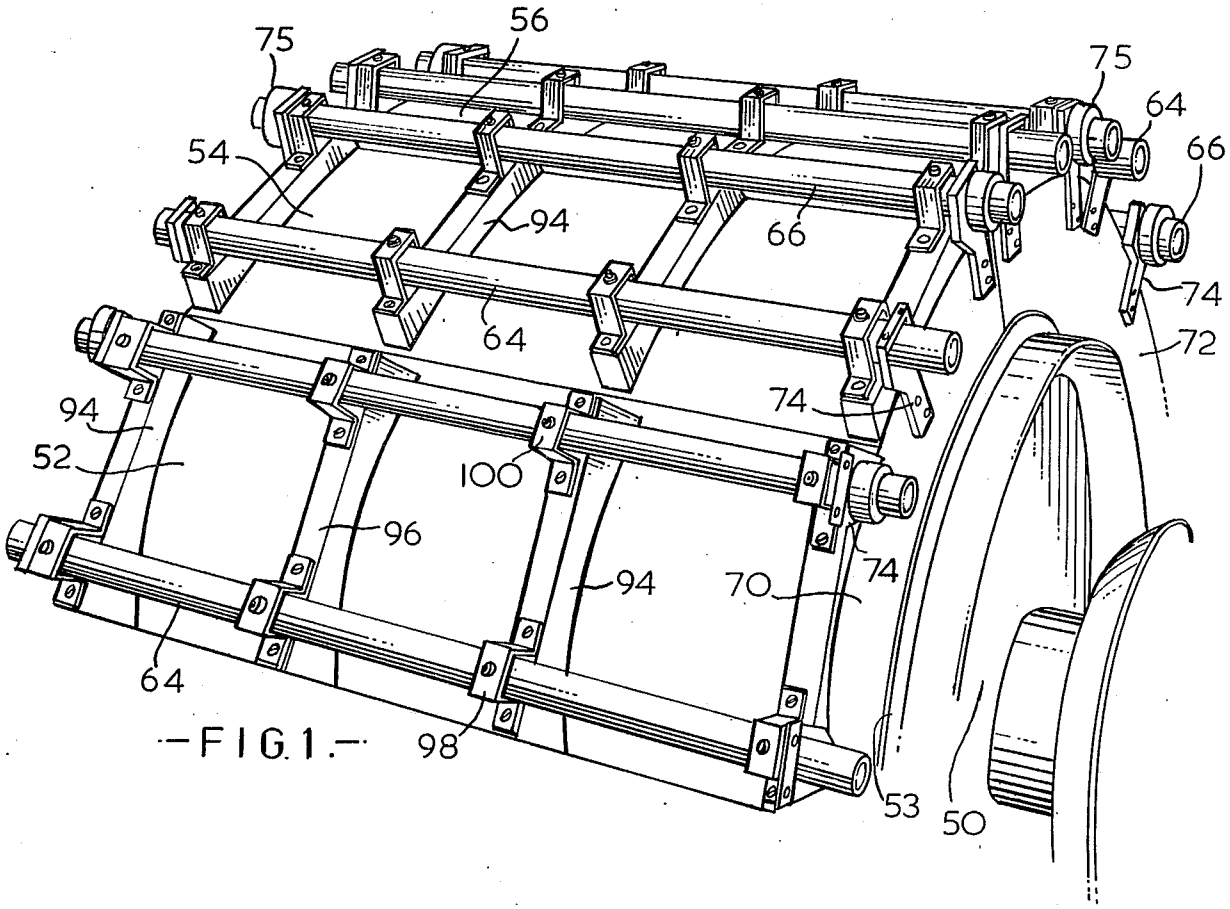

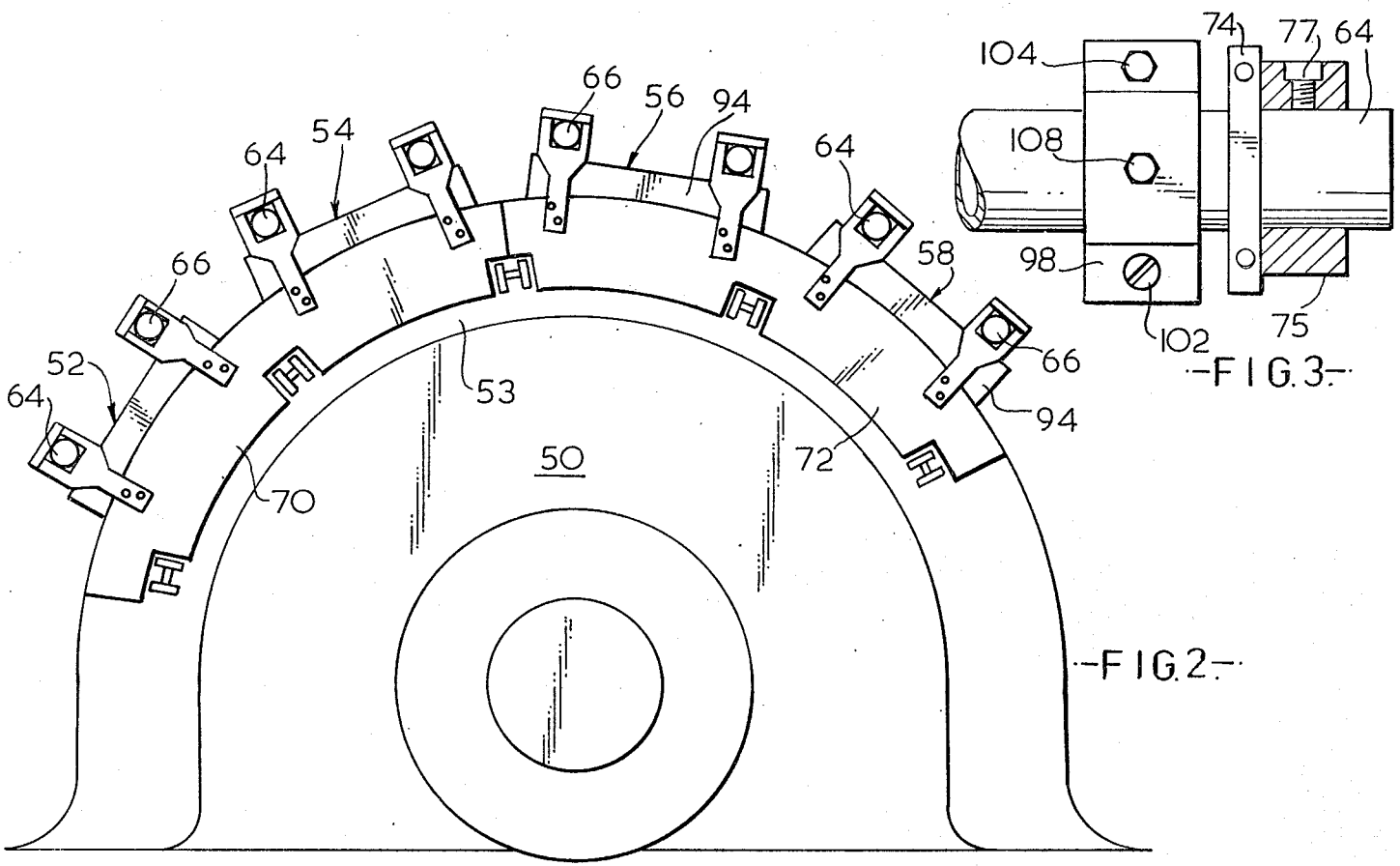
-FIG.3-
-FIG.2-

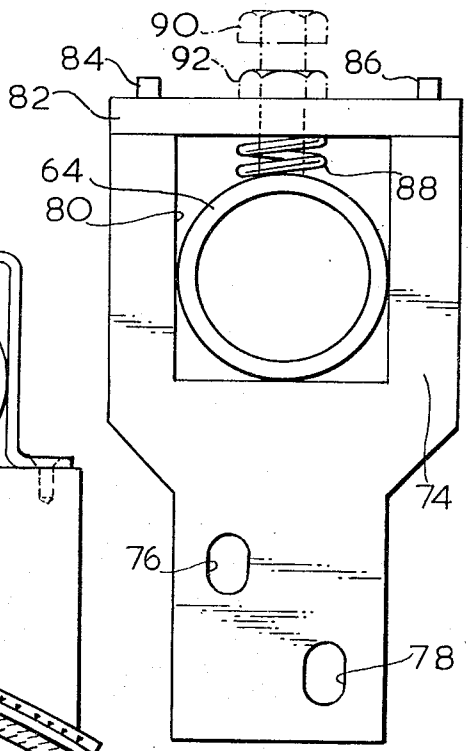
-FIG.4.-
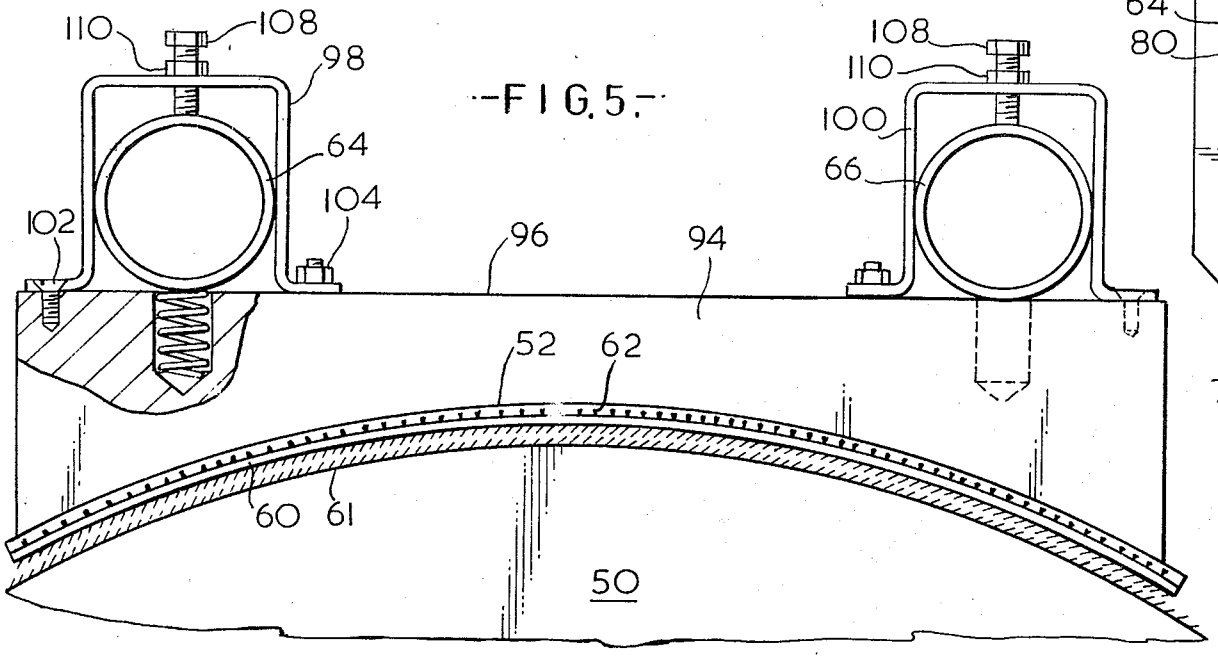
-FIG.5.-

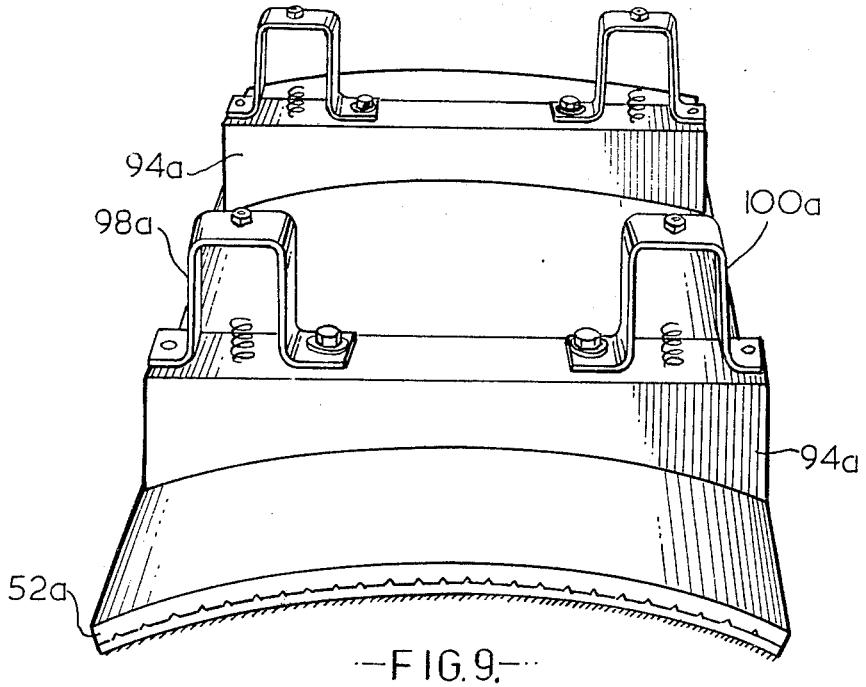
—FIG. 9.—

CARDING APPARATUS

CROSS REFERENCE TO RELATED APPLICATION

This is a continuation -in-part of Ser. No. 516,581, filed Oct. 21, 1974 abandoned.

Carding machines are sometimes equipped with stationary carding plates curved about the axis of the swift or cylinder with which they co-operate. It is the practice to mount the card-clothing on relatively thick and therefore rigid plates. When such plates are used especially on wide cards, it is common to find that there are considerable variations in the setting of the teeth across the width of the machine. Hence the carding action is not as even as desirable.

According to one aspect of the invention a stationary carding plate assembly comprises a rigid support frame arranged so that when secured to the stationary frame of the carding machine it extends over the part of the machine occupied by the swift or cylinder; and one or more arcuate plates for supporting the card clothing or other carding media on the concave side, the plate or plates being suspended from the support frame. Preferably the support frame is adapted to be secured to the stationary frame of the carding machine at or near its ends, so that it is adapted to bridge the parts of the machine frame on opposite sides of the swift or cylinder.

According to other preferred features of the invention, there are two or more arcuate plates suspended from the support frame, these plates being arranged end-to-end across the width of the support frame, and there are mounting means whereby the or each carding plate is adapted to be adjusted towards and away from the support frame. It is also preferred to provide the or each carding plate with at least two laterally spaced mountings by which it is suspended from the support frame and to provide that each mounting is independently adjustable to adjust the displacement of the part of the plate in the region of that mounting from the support frame.

According to yet another aspect of the invention a stationary carding plate assembly comprises a relatively rigid frame adapted to be secured at or near its ends, to stationary parts of a carding machine whereby the frame can bridge part of the machine occupied by the swift or cylinder, an arcuate plate for supporting the card clothing or other carding media on its concave side, and at least three mounting devices attaching the plate to the frame at positions spaced apart across the width of the assembly. It will be appreciated that with such an assembly two functions which would otherwise conflict with each other have been separated so that:

- the rigidity desirable to minimise setting variations is supplied by the frame, and
- the capability of formation into an arcuate shape is supplied by the plate itself.

According to another aspect of the invention a stationary carding plate is resilient in a direction substantially perpendicular to the card clothed surface, and has a series of at least three adjustable mounting devices arranged at spaced positions on the plate, each mounting device being adapted to produce adjustment of an area of the plate in the region of that device as permitted by the resilience of the plate.

According to a preferred feature of the invention, these two latter aspects of the invention are combined, that is to say a stationary carding plate assembly comprises a relatively rigid frame adapted to be secured at or near its ends to stationary parts of a carding machine whereby the frame can bridge the part of the machine occupied by the swift or cylinder, an arcuate plate for supporting the card clothing or other carding media on its concave side, the plate being resilient in a direction perpendicular to the card clothed surface, and a series of mounting devices arranged at spaced poritions on the plate and connecting the plate to the frame, each mounting device being adapted to produce adjustment of an area of the plate in the region of that device as permitted by the resilience of the plate.

Preferably each adjustable mounting device has clamping elements adapted to engage in opposite sides of a substantially rigid bearer (which may form part of the frame) adapted to be secured to the machine frame, the clamping elements acting substantially in the direction of permitted adjustment of the plate. One form of clamping element is a screw-and-nut mechanism, and another is a compression spring. In the preferred arrangement each mounting device comprises oppositely acting screw-and-nut and spring elements.

According to another preferred feature of the invention each adjustment mounting device incorporates a resiient element (which may be the compression spring clamping element) adapted to permit flexing of the region of the plate adjacent to that mounting device away from the cylinder or swift with which it co-operates. This enables regions of the plate to move relatively to the swift or cylinder to allow larger than normal lumps of material being carded to pass without damaging the card clothing.

In a preferred construction the rigid frame comprises a pair of parallel rods each of which is supported near to each end from the bends of the carding machine, so that the two rods extend across the width of the machine, and the plate is carried on a series of spaced mounting blocks each of which carries a pair of brackets which engage respectively over the two parallel rods, there being a compression element acting between the underside of each rod and the block, and a screw-and-nut device acting between the top side of each of the parallel rods and its associated bracket.

The invention has been found to be particularly useful with a stationary carding plate o the type described in the Specification of U.S. patent application Ser. No. 510,790.

Figure 6:
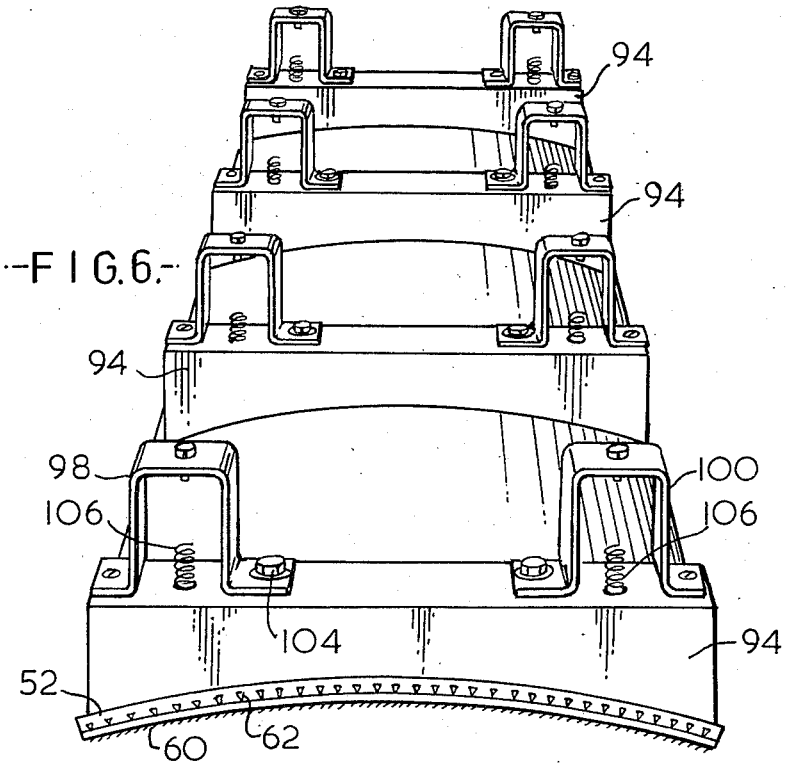
Figure 7:
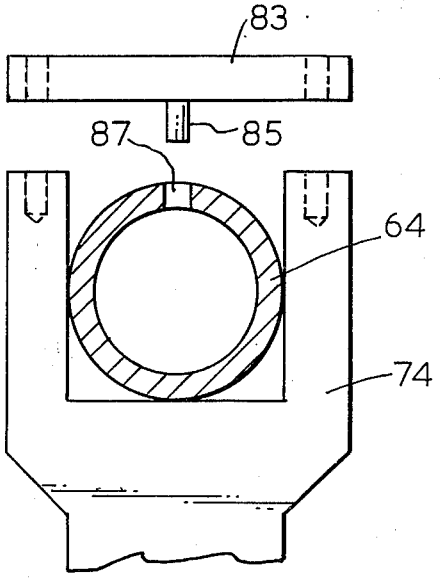
Figure 8:
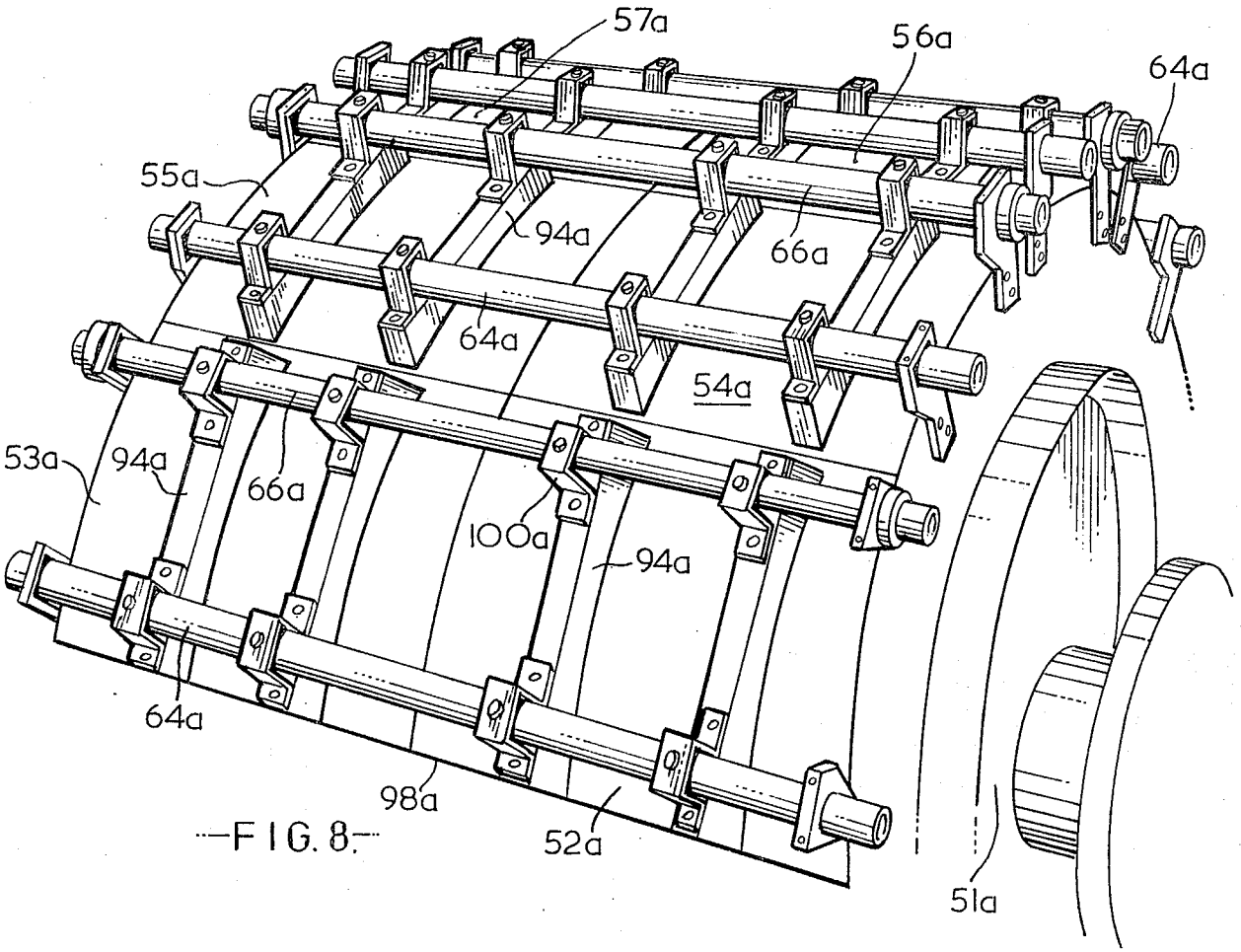

Acarding machine incorporating two forms of apparatus each in accordance with the invention will now be described by way of examples only. In the accompanying drawings:

FIG. 1 is a perspective view of the cylinder and associated parts of a carding mechanism, FIG. 2 is an end view of the cylinder shown in FIG. 1, FIG. 3 is a detail view of a mounting arrangement for a support rod, FIG. 4 is a detail view of a mounting bracket, FIG. 5 is a cross-section through a stationary carding plate assembly, FIG. 6 is a perspective view of a carding plate removed from the machine, FIG. 7 is a detail view partly in section similar to FIG. 4, but showing a locating device, FIG. 8 is a perspective view of the cylinder and associated parts of a carding machine showing an alternative arrangement, and FIG. 9 is a perspective view of a carding plate, as used in the machine shown in FIG. 8, removed from the machine.

In the carding arrangement which is illustrated in FIGS. 1 to 7, the carding machine which is shown is a cotton type card, wherein there is a single card-cylinder 50 (see FIG. 2). At each side of the cylinder there is a metal bend 53 which forms part of the stationary framework of the machine. It is customary to have a set of moving card-clothed flats over the upper part of the cylinder 50, but in the present instance, these are replaced by a set of four stationary card-clothed arcuate plates 52, 54, 56 and 58.

Each plate 52, 54, 56 or 58 is so formed that it is concentric with the axis of rotation of the swift or cylinder 50. Card-clothing 60 (see FIG. 5) — which may be of the flexible or metallic wire type — is applied to the concave surface of the plate and, in use, this card-clothing co-operates with the card-clothing 61 on the cylinder 50 to provide the carding action. The plate itself is made of timber and in order to give it the necessary degree of flexibility to allow it to be bent to the contour of the card-clothing, a series of saw-cuts 62 is formed in the inside of the wood sheet, each cut extending longitudinally of the sheet (i.e. parallel to the axis of rotation of the swift 50). The timber sheet is bent to the required arcuate form, and the bending operation causes each of the saw-cuts to partially close so that it is of Vee-shaped cross-section. Resinous material in fluid form is applied all over the concave face of the timber sheet, and allowed to flow into each of the saw-cuts of the timber sheet. The card-clothing 60 is secured to the timber sheet by the resin, and when the resin sets, it prevents the Vee grooves opening, thus holding the timber sheet in the bent, arcuate form. This provides the necessary rigidity for the card-clothed element, but it will be appreciated that by virtue of the fact that the plate is basically made of timber, it does have a certain amount of resilience, particularly in radial directions relatively to the axis of rotation of the swift 50.

It will be appreciated, that the plate 14 described above, is made in accordance with one of the methods described in the Specification of U.S. patent application Ser. No. 510,790, but that it could in fact be made of any of the other methods described in that specification.

For the purpose of mounting the stationary plate on the carding machine, a relatively rigid frame is provided, and this basically takes the form of two tubular rods 64 and 66, these being relatively massive in size so as to act as support beams of the rigid frame, extending across the width of the machine, and projecting somewhat beyond each of the bends 53. The tubular rods 64 and 66 are of substantial proportions, and are made in steel, so that normal operating loads encountered during the carding action, are insufficient to produce any appreciable deflection of these rods.

At each side of the machine, the customary flexible bends are removed, and replaced by two rigid curved plates 70 and 72 which are secured to the fixed bend 53. A mounting bracket 74 is provided at each end of each rod 64 or 66, and this bracket is secured to the plate 70 or 72 as the case may be, by set screws passed through slots 76 and 78 in the lower part of the bracket (see FIG. 4) these set screws engaging in screw-threaded holes in the plates 70 and 72. The slots 76 and 78 permit some adjustment of the bracket in a radial direction relatively to the axis of rotation of the cylinder 50. The permitted adjustment of each pair of brackets 74 which are associated with one end of one of the carding plates 52, 54, 56 and 58 is in a direction parallel to a radius passing through the centre of the width of the plate.

The upper part of each mounting bracket 74 is bifurcated, and the end of the rod 64 or 66 rests on the flat bottom of an open-topped slot 80. The top of this slot 80 is closed by a cap 82, which bridges the slot and is secured to the limbs of the bifurcated portion by screws 84 and 86. A powerful compression spring 88 is located between the top of the rod 64 and the underside of the cap 82, this spring normally holding the rod in its lowest position in the slot 80 as illustrated. However if a large lifting force is applied to the rod 64, then the compression spring 88 will yield to allow the rod to rise slightly. In some instances, it may be desirable to prevent any lifting of the rod 64, in which case, a stop screw 90, shown in chain dotted lines in FIG. 4, and engaged in a screw-threaded hole in the cap 82 is secured into engagement with the top of the rod 64 and then locked by a nut 92.

A method of locating the rod 64 angularly with respect to its own longitudinal axis and axially, is shown in FIG. 7. The mounting bracket 74 is identical with that shown in FIG. 4, but its cap 83 is provided with a depending peg 85, which is a close fit within a radial hole 87 in the rod 64. It is only necessary to provide a peg 85 at one end of the rod 64, and in practice, the hole 87 will be drilled, and the peg 85 fitted on the machine when the carding plates are being fitted.

If the carding plate assembly including the rods is removed from the machine, then when it is replaced, the location of the pegs 83 in the holes 87 will ensure that the rods 64 and 66 occupy the same position relatively to the cylinder or swift that they did previously and hence the adjusted positions of the carding plates relatively to the cylinder or swift will remain the same as previously. A spring such as the spring 88 can be used with the locating arrangement shown in FIG. 7.

At a series of spaced apart positions across the width of the timber plate 52, 54, 56 or 58 there are provided timber blocks 94 which are secured to the plate, by screws and/or adhesive. Each of these blocks 94 is arcuate on its inside edge, to conform to the convex shape of the outer face of the plate 52, 54, 56 or 58, but its outside edge 96 is straight, and presents a surface which is tangential to an arc drawn about the axis of rotation of the cylinder 50. A pair of metal brackets 98 and 100 is provided on each of the blocks 94, each of these brackets being secured to its block 94, by a screw 102 and a bolt and nut 104 (see FIG. 5). The brackets 98 and 100 and their associated parts are identical, so that it is only necessary to describe one in detail, and it will be observed from FIGS. 1 and 5, that the tubular rods 64 and 66 are received within the brackets 98 and 100 respectively.

A powerful compression spring 106 is located on a hole 108 formed in the block 94, beneath the bracket 98 or 100, and this compression spring acts between the block 94 and the rod 64 or 66. An adjusting screw 108 passes through a screw-threaded hole in a bridge portion of the bracket 98 or 100, and engages with the top side of the rod 64 or 66, the adjusting screw being locked in any preselected position, by means of a lock nut 110.

A collar 75 is secured by a grub screw 77 on each end of one of the rods 64 and 66, of each pair, this collar abutting the outer face of the adjacent mounting bracket 74, as shown in FIG. 3. The collars 75 serve to locate the rods 64 and 66 together with their carding plates 52, 54, 56 and 58 laterally of the carding machine, so that the card-clothed underside of each plate is properly aligned with the cylinder 50. However, the collar 75 will not be required if pegs 83 are fitted to provide endwise location for the rods 64 and 66 and the plates carried thereon, as described with reference to FIG. 7.

It will be observed therefore, that the stationary carding plate 52, 54, 56 or 58 is suspended from the relatively rigid rods 64 and 66 and that whereas major adjustments in the positioning of the carding plate relative to the cylinder 50 can be effected by adjustment of the position of the mounting plates 74, precise positioning of the carding plate is permitted by adjustment of the screws 108, which compress the compression springs 106 to a greater or lesser extent, and thereby locate the carding plate relatively to the rods 64 and 66. Apart from the possibility of positioning the carding plate concentric with the cylinder 50, it is also possible by virtue of the permitted adjustments to position the carding plate, so that the leading or trailing end is closer to the periphery of the cylinder than the other, an arrangement which is sometimes favoured by carding engineers.

It has been found very difficult to produce an even setting of the card clothing 60 on a stationary carding plate relatively to the card-clothing on the periphery of the cylinder 50, because of the large size of the carding plate, and in particular because of the width which it has to bridge between the bends of the carding machine. However, with the arrangment described above, it is possible to make regional adjustments in the setting between the plates and the swift or cylinder, by utilising the adjustment provided by the screws 108. Thus for example, if it is found that the carding plate tends to deflect downwardly at the centre of its width, then the screws 108 on the brackets 98 and 100 adjacent to the central area, can be tightened to a greater extent than those towards the bends, so that the central part of the plate is deflected upwardly, to compensate for its natural downward deflection. In fact, it is even possible to provide for even more localised deflection of the carding plate, to compensate for some irregularity in manufacture.

Moreover, during a carding operation, if an excessively thick piece of material enters the space between the cylinder and the carding plate, then it is possible for that region of the carding plate to deflect slightly upwardly, as permitted by the compression springs 106, to allow the excessively thick piece of material to pass, without damage to the card-clothing or other parts of the machine.

If there is some large force applied to the underside of the plate 52, 54, 56 or 58 (caused for example, by some metallic object attempting to pass between the cylinder 50 and that plate), then the entire assembly of the plate, its brackets 98, 100 and its rods 64 and 66 can rise as permitted by yielding of the springs 88, to allow the obstruction to pass without excessive damage to the carding plates.

It is to be understood, that the invention is not restricted to the use of stationary carding plates made according to any particular method. In fact, the carding plates could be constructed of sheet metal, and in fact quite thin sheet metal could be used for this purpose, since the blocks 94 will give it a certain amount of strength, and in any case, any localised deflections of the plate can be compensated for by the mounting arrangement just described.

It is also to be understood, that a stationary carding plate could be supported on a single bearing rod, instead of the two bearing rods 64 and 66 described above, particularly if the carding plate itself is relatively short in the direction of curvature. Clearly of course, there may be more than two bearings rods for each plate, if the plate is quite large.

It should also be understood that instead of each carding plate extending across the full width of the machine, there could be two or more narrower carding plates of the same construction, mounted end-to-end on the pair of rods 64 and 66 (or on a single rod if desired). It is still preferable however to provide a plurality of mounting positions for each such plate to allow the plate to be deflected regionally to provide for arcuate setting of the plate relatively to the swift or cylinder.

The alternative carding machine which is shown in FIGS. 8 and 9 is very similar to that illustrated in FIGS. 1 to 7, in that there is a single card cylinder with a metal bend 51*a* which forms part of the stationary framework of the machine at each side of the cylinder. As in the previous example, the customary moving flats are replaced by a set of stationary card clothed arcuate plates 52*a*, 53*a*, 54*a*, 55*a*, 56*a*, 57*a* . . . , but in this arrangement, each plate extends only half way across the width of the cylinder, so that two plates (such as 52*a* and 53*a*) have to be placed end-to-end to cover the width of the cylinder. Hence, instead of the four plates used in the previously described arrangement, eight plates are required to provide the full carding plate assembly.

For the purpose of mounting each side-by-side pair of stationary plates, there is a rigid frame comprising two tubular rods 64*a* and 66*a*, which extend across the width of the machine, and which are mounted on the bends 51*a* in the same manner as the rods 64 and 66 shown in FIGS. 1, 2 and 5. As with the plates previously described, timber blocks 94*a* are secured to each of the carding plates, but in this instance, as the plates are shorter, there may be only two such blocks on each plate. Also each block 94*a* has a pair of metal brackets 98*a* and 100*a* and there are compression springs and adjusting screws whereby the plate can be suspended from the pair of rods 64*a* and 66*a* exactly as has been previously described with reference to the first arrangement.

Now with the arrangement shown in FIGS. 8 and 9, it is not possible to cause the plates to deflect, because there are only two transversely spaced mounting positions on each plate. However, it is possible to adjust each plate separately to produce regional adjustments of the carding surface. It is also possible to tilt each plate by adjusting only two of its four adjusting screws.

It will be appreciated that if the machine is very wide, that it may be desirable to have three or more short plates arranged end-to-end across the width of the machine. It is also to be understood that the invention is not limited to the particular mounting arrangement for the tubular rods which has been described, so long as the rods (or other rigid frame) extends over at least part of the width of the cylinder. For instance, instead of the rods completely bridging the bends, they could be supported cantilever fashion from one side of the machine.

What is claimed is:

1. For use in a carding machine assembly having a rotating cylinder, a stationary carding plate assembly comprising a relatively rigid support structure adapted to be mounted in association with said carding machine whereby said support structure can bridge the part of the machine occupied by the rotating cylinder, an arcuate plate having card clothing on its concave front face, and means mounting said plate on said support structure comprising at least two mounting members secured on the back face of the plate in spaced relation laterally with respect to the axis of the cylinder and at least two devices connecting each said member to the support structure, each said device being spaced circumferentially of the cylinder and having means for adjustably displacing said plate relative to said support structure.

2. A stationary carding plate assembly as claimed in claim 1, in which said support structure is adapted to be secured substantially at its lateral ends to the carding machine so that said support structure bridges the carding machine cylinder.

3. A stationary carding plate assembly as claimed in claim 1, in which there are at least two arcuate plates suspended from said support structure said plates being arranged side-by-side across the width of the support structure.

4. A stationary carding plate assembly as claimed in claim 1 wherein said mounting members secured on the back face of the plate are at least three in number.

5. A stationary carding plate assembly as claimed in claim 1, said support structure including a plurality of beams bridging said cylinder and in which each connecting device has clamping elements adapted to engage on opposite sides of an associated beam, the clamping elements acting in a direction which is substantially radial of the cylinder when the assembly is in position on the machine.

6. A stationary carding plate assembly as claimed in claim 5, wherein at least one clamping element comprises a screw-and-nut mechanism.

7. A stationary carding plate assembly as claimed in claim 5, wherein one clamping element comprises a compression spring.

8. A stationary carding plate assembly as claimed in claim 5, wherein each connecting device comprises oppositely acting screw-and-nut and compression spring elements.

9. A stationary carding plate assembly as claimed in claim 5, in which each beam is carried at or near its ends by a mounting bracket adapted to be secured to the machine, and permitting limited movement of the beam in a substantially radial direction relative to the cylinder when the assembly is in position on the machine.

10. A stationary carding plate assembly as claimed in claim 9, wherein the permitted radial movement of the beam is resiliently opposed.

* * * * *